US009371650B2

(12) United States Patent
Linares, III

(10) Patent No.: US 9,371,650 B2
(45) Date of Patent: Jun. 21, 2016

(54) PRECAST CONCRETE SANDWICH PANELS AND SYSTEM FOR CONSTRUCTING PANELS

(71) Applicant: Manuel R. Linares, III, Tampa, FL (US)

(72) Inventor: Manuel R. Linares, III, Tampa, FL (US)

( * ) Notice: Subject to any disclaimer, the term of this patent is extended or adjusted under 35 U.S.C. 154(b) by 0 days.

(21) Appl. No.: 14/665,101

(22) Filed: Mar. 23, 2015

(65) Prior Publication Data

US 2015/0191909 A1 Jul. 9, 2015

Related U.S. Application Data

(60) Provisional application No. 61/969,304, filed on Mar. 24, 2014.

(51) Int. Cl.

| | |
|---|---|
| ***E04C 2/288*** | (2006.01) |
| ***E04B 2/00*** | (2006.01) |
| ***E04C 2/06*** | (2006.01) |
| *E04C 2/04* | (2006.01) |

(52) U.S. Cl.

CPC . *E04C 2/288* (2013.01); *E04C 2/06* (2013.01); *E04C 2/46* (2013.01); *E04C 2002/048* (2013.01)

(58) Field of Classification Search

CPC ..... E04C 2/288; E04C 2/46; E04C 2/06; E04C 2002/048

USPC ..... 52/309.11, 309.16, 309.17, 319, 340, 52/341, 474, 481.1, 479, 404.1, 405.3

See application file for complete search history.

(56) References Cited

U.S. PATENT DOCUMENTS 1,779,713 A * 10/1930 Satterlee ..... E04B 2/58 52/236.6
3,305,986 A * 2/1967 Mathews ..... F25D 23/063 52/270
3,401,494 A * 9/1968 Anderson ..... E04C 2/205 52/309.11
3,604,174 A * 9/1971 Nelson, Jr. ..... E04C 2/384 52/601
3,798,856 A * 3/1974 Gloskowski ..... E04G 21/26 248/354.3
4,125,981 A * 11/1978 MacLeod ..... E04B 1/161 52/309.12
4,454,702 A * 6/1984 Bonilla-Lugo ..... E04B 2/847 52/251
4,604,839 A * 8/1986 Esposito ..... E04H 13/006 52/124.2
4,624,089 A * 11/1986 Dunker ..... E04B 2/30 52/309.11
4,930,269 A * 6/1990 Kelly ..... E04G 21/142 294/82.35
4,943,336 A * 7/1990 Csont ..... E04B 2/845 156/182
5,014,473 A * 5/1991 Kelly ..... E04G 21/142 294/82.35
5,058,345 A 10/1991 Martinez
5,094,047 A * 3/1992 Kelly ..... E04G 21/142 52/125.5
5,226,265 A * 7/1993 Kelly ..... E04G 21/142 294/82.35

(Continued)

*Primary Examiner* — Brent W Herring
(74) *Attorney, Agent, or Firm* — Thomas Frost

(57) ABSTRACT

The present invention is a precast concrete sandwich panel utilizing a low density polyethylene channel with basalt fiber rod attached to the side of the channel during construction, and utilizing spray foam insulation as the inner layer between the two concrete outer panels (wythes).

2 Claims, 13 Drawing Sheets

(56) References Cited

U.S. PATENT DOCUMENTS 5,440,845 A 8/1995 Tadros et al.
5,592,848 A * 1/1997 Bodnar ..... E04B 1/161 29/415
6,000,194 A 12/1999 Nakamura
6,003,278 A * 12/1999 Weaver ..... E04C 2/382 249/26
6,088,985 A 7/2000 Clark
6,138,981 A * 10/2000 Keith ..... E04G 17/06 249/19
6,272,805 B1 * 8/2001 Ritter ..... E04C 2/044 52/309.11
6,279,274 B1 * 8/2001 Amiet ..... E04C 5/168 52/125.2
6,341,452 B1 * 1/2002 Bollinghaus ..... E04G 21/142 249/175
6,761,007 B2 * 7/2004 Lancelot, III ..... E04C 2/044 52/309.7
6,955,014 B2 * 10/2005 LeJeune ..... B28B 23/0025 52/220.2
7,143,559 B1 * 12/2006 Ritter ..... E04C 2/044 52/309.11
7,784,235 B2 * 8/2010 Cretti ..... E04B 5/19 52/309.12
7,856,778 B2 12/2010 Pantelides et al.
7,950,190 B2 * 5/2011 Schulze ..... B28B 23/005 52/125.2
8,312,683 B2 11/2012 Tadros et al.
8,683,765 B2 * 4/2014 Hillers ..... E04B 1/14 52/309.11
2003/0136071 A1 7/2003 Kobayashi
2003/0167716 A1 * 9/2003 Messenger ..... E04C 2/044 52/309.12
2005/0102968 A1 5/2005 Long et al.
2005/0210767 A1 * 9/2005 DeFever ..... E04B 1/169 52/80.1
2007/0039276 A1 * 2/2007 Sorensen ..... E04C 5/0645 52/633
2008/0041004 A1 * 2/2008 Gibbar ..... E04C 2/288 52/309.12
2009/0113829 A1 * 5/2009 Meier ..... E04C 2/044 52/405.3
2010/0037536 A1 * 2/2010 Schulze ..... B28B 23/005 52/125.4
2011/0061329 A1 * 3/2011 Tadros ..... E04C 2/044 52/583.1
2011/0262263 A1 * 10/2011 Comerford ..... E04G 21/142 414/800
2013/0074433 A1 * 3/2013 Ciuperca ..... E04B 1/355 52/426
2013/0239503 A1 * 9/2013 Miller ..... C04B 20/0068 52/414
2014/0311081 A1 * 10/2014 Parham ..... E04C 5/20 52/677

* cited by examiner

PRECAST CONCRETE SANDWICH PANELS AND SYSTEM FOR CONSTRUCTING PANELS

FIELD OF THE INVENTION

The present invention relates to constructing precast concrete sandwich panels utilizing a low density polyethylene channel with basalt fiber rod attached to the side of the channel and utilizing a polyurethane spray foam insulation as the inner layer between the two concrete outer panels (wythes).

BACKGROUND OF THE INVENTION

Concrete sandwich panels are used in concrete and precast wall construction. A sandwich panel consists of three layers, commonly called wythes. The two outer layers are concrete with reinforced and the inner layer is comprised of insulating material. The purpose is for the insulating layer to have a high R-factor (measure of thermal resistance) and provide an energy efficient complete wall system in one panel. The standard insulating panel is composed of polystyrene and the like. Ties are used in connection with the insulating panel to mechanically join the insulating layer and the two concrete reinforced panels.

The current invention is directed to a new method for constructing a concrete sandwich panel. Among the improvements is the liquid application of polyurethane foam as the insulating layer during construction. Additionally, a polyethylene channel with basalt fiber rods in wave or square pattern affixed to opposed sides of the channel is employed as a tie during the construction process to join the two concrete panels.

SUMMARY OF THE INVENTION

The general purpose of the present invention, which will be described subsequently in greater detail, is to provide a new and improved system for constructing a precast concrete sandwich panel.

The precast concrete sandwich panel is comprised of opposed wythes having a foam insulation layer disposed between the wythes. During construction a series of low density polyethylene channels with basalt fiber rod attached to the side of the channels are utilized as ties to join the wythes and provide structural integrity to the finished panel.

A plurality of brace inserts and lift inserts are mounted on the channels during construction.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
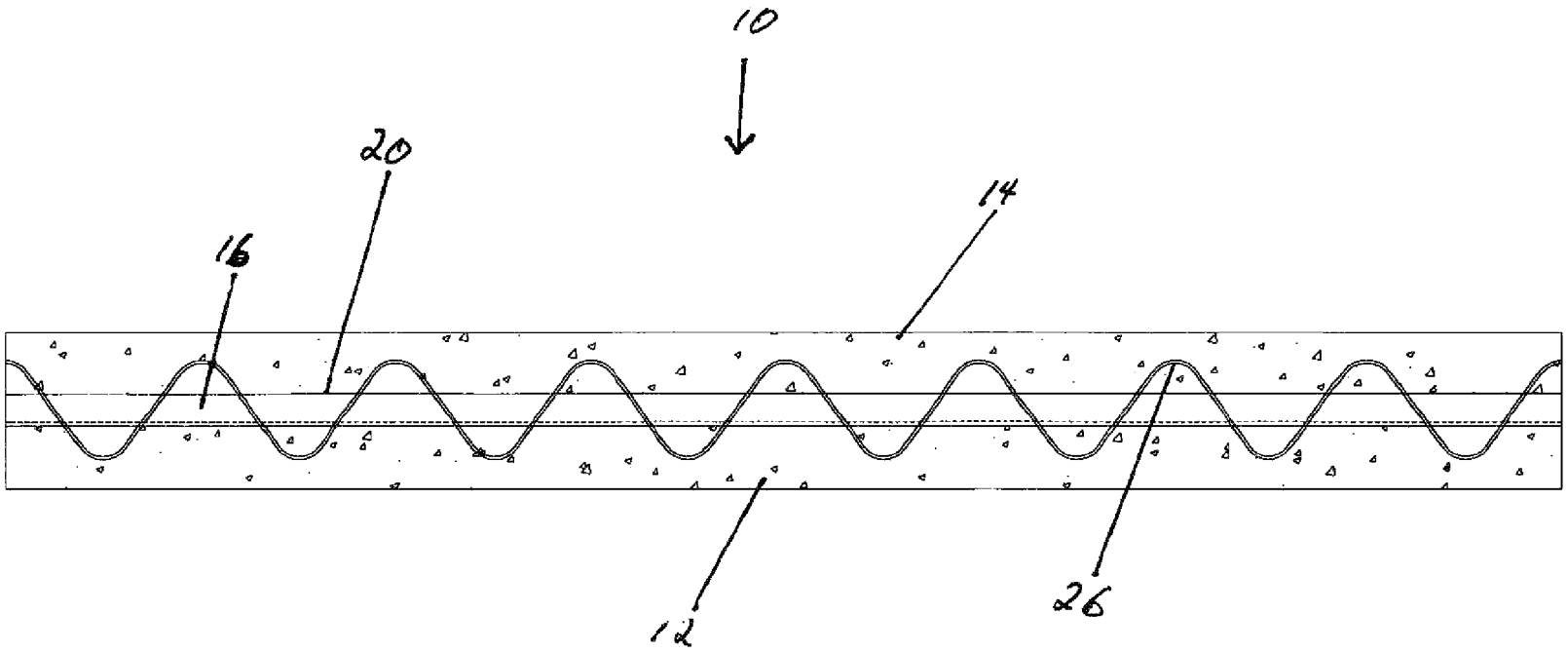
FIG. 1 is a side cross-sectional view of the present invention.

Referring generally to the FIGS. 1, 4-8, the invention 10 is illustrated. A precast concrete panel 10 has a concrete lower wythe 12, a concrete upper wythe 14 and an inner layer 16 comprised of insulating material disposed between the wythes 12, 14. The wythes 12, 14 have reinforced materials, embeds and other necessary non-insulating elements disposed therein.

Figure 2:
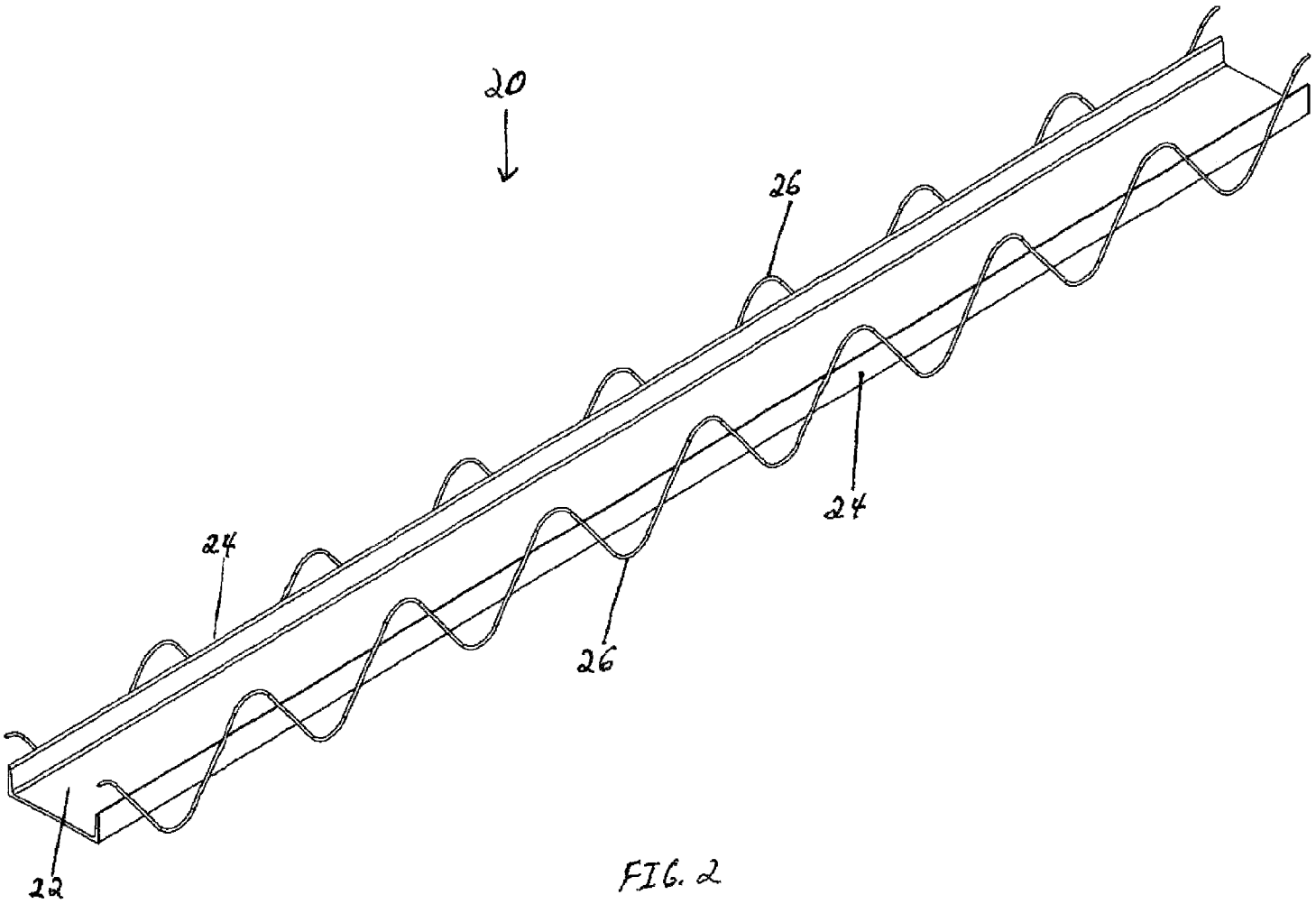
FIG. 2 is an orthogonal view of a channel with fiber rods affixed.

FIG. 2 illustrates a channel 20 used in the construction of the insulation system for concrete tilt-up panels. The channel 20 has a base wall 22 and a pair of opposed side walls 24. The side walls 24 are aligned perpendicular to each other. The channel 20 is preferably formed of low density polyethylene (LDPE). A pair of basalt fiber rods 26 are permanently affixed to the outer surface of the opposed walls. The channel 20 is designed to facilitate the alignment of the rods 26 during construction. The rods 26 in FIG. 2 are in a sine wave pattern defined by peaks spaced at a regular interval and with peak-to-peak amplitude greater than the insulating layer. The rods 26 mechanically join with the lower wythe and the upper wythe. The rods 26 are composed of basalt fiber, which has superior structural capacity in comparison to fiberglass and is less expensive than carbon fibers. The use of fiberglass and carbon fibers are already known in wave-shaped ties used in concrete sandwich panel construction.

Figure 3:
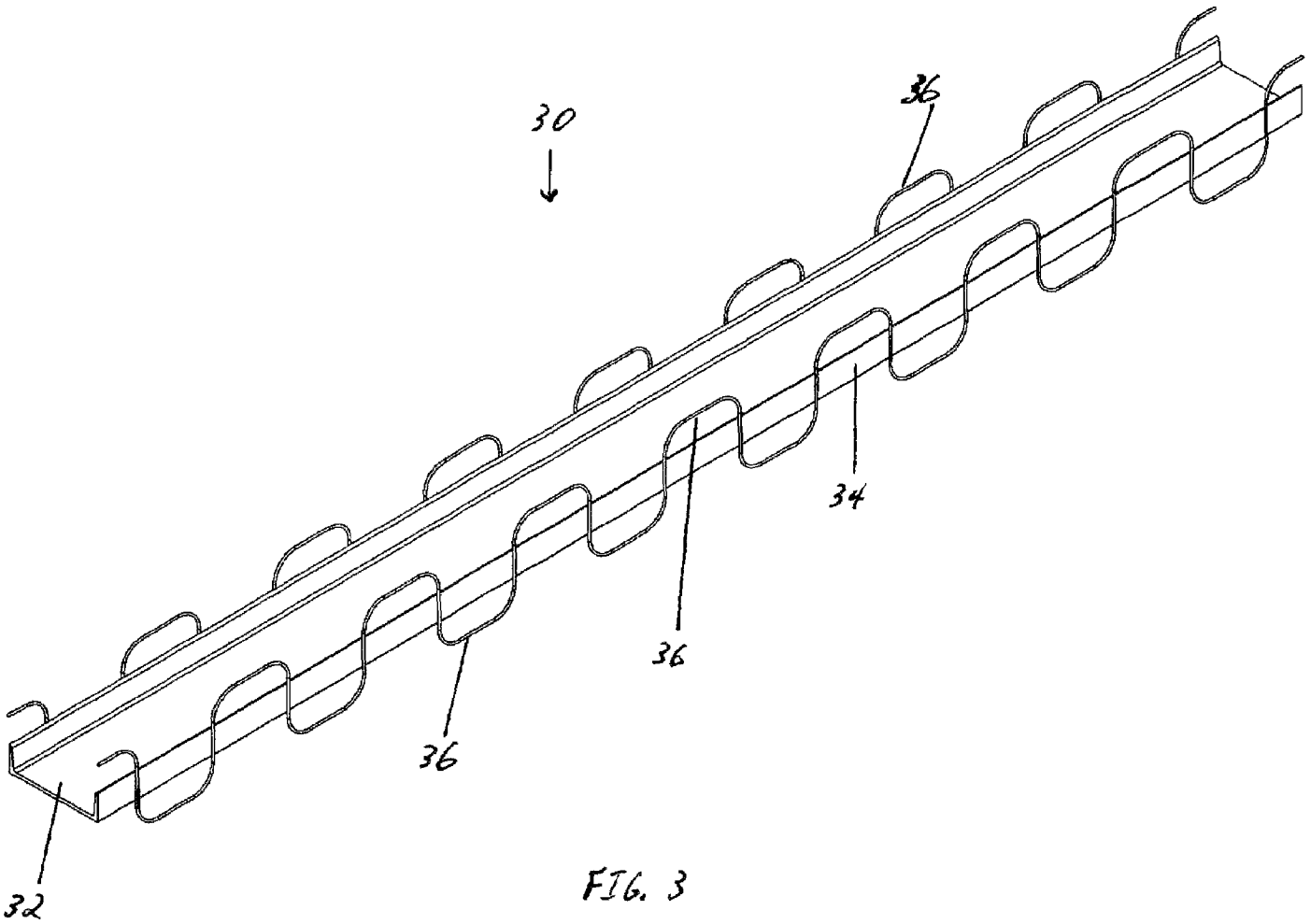
FIG. 3 is a channel with an alternative fiber rods configuration affixed.
Figure 4:
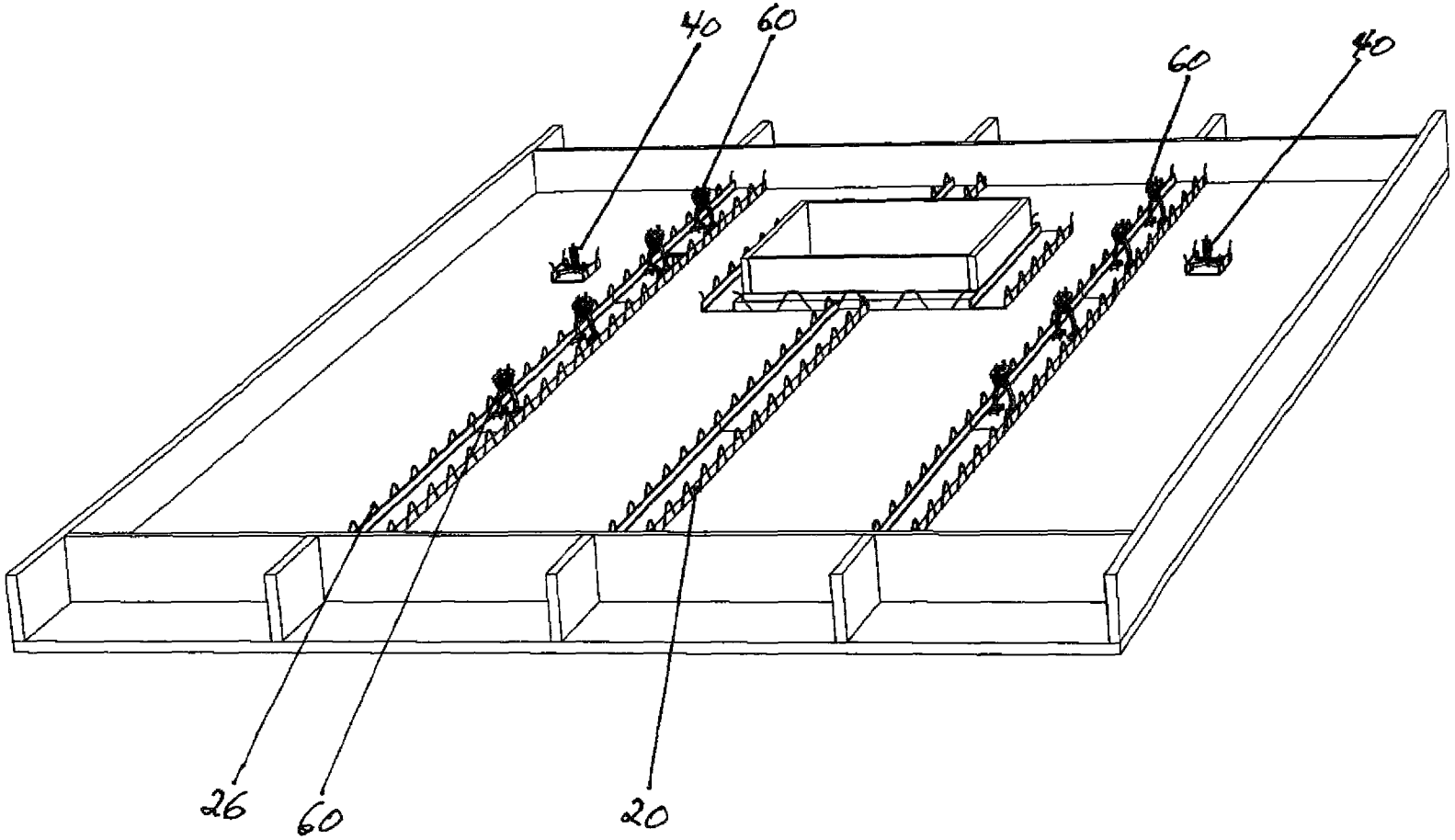
FIG. 4 is a perspective view of the invention during construction phase.
Figure 5:
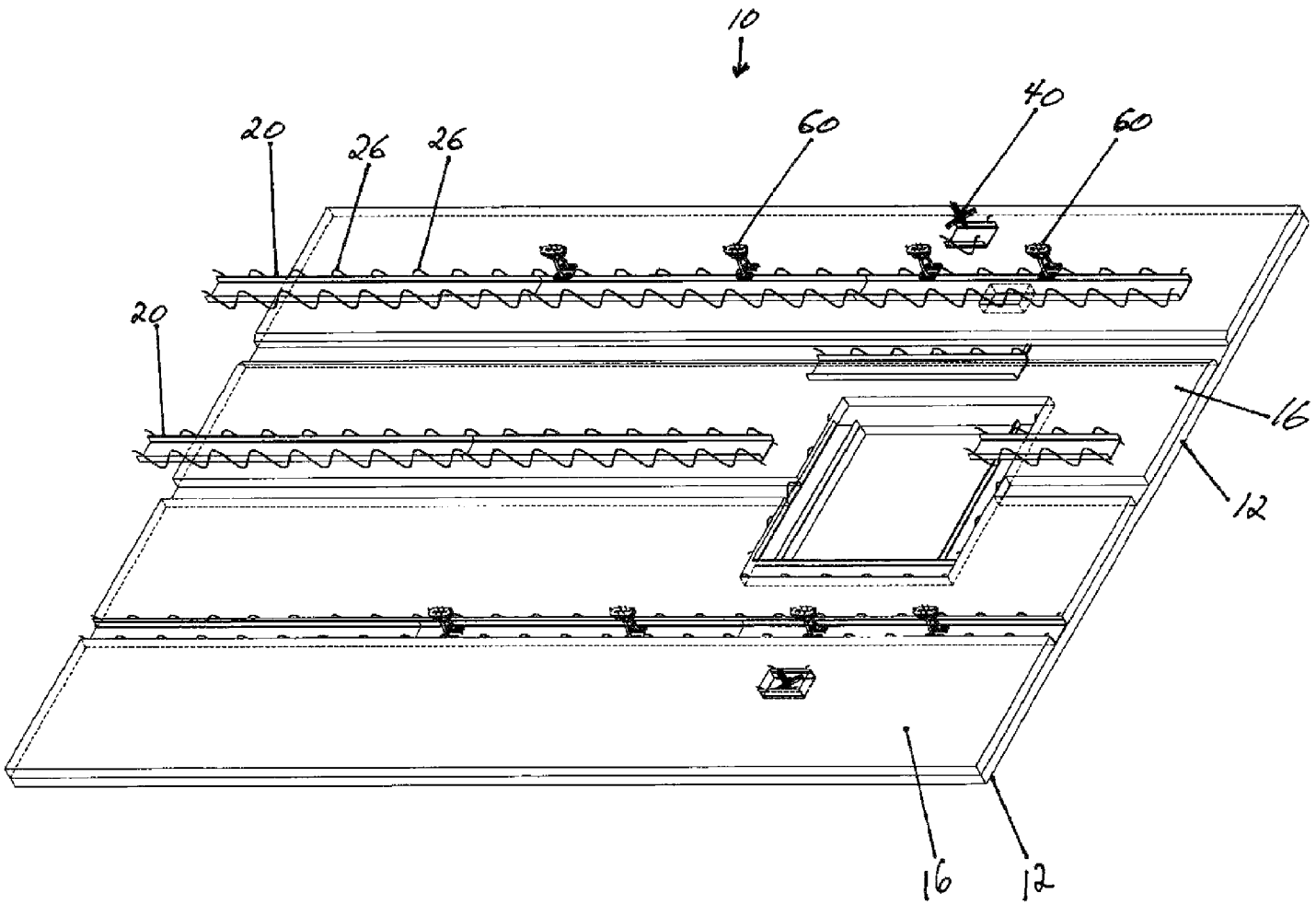
FIG. 5 is a exploded view during a second phase of construction with an insulation layer mounted on lower concrete wythe.
Figure 6:
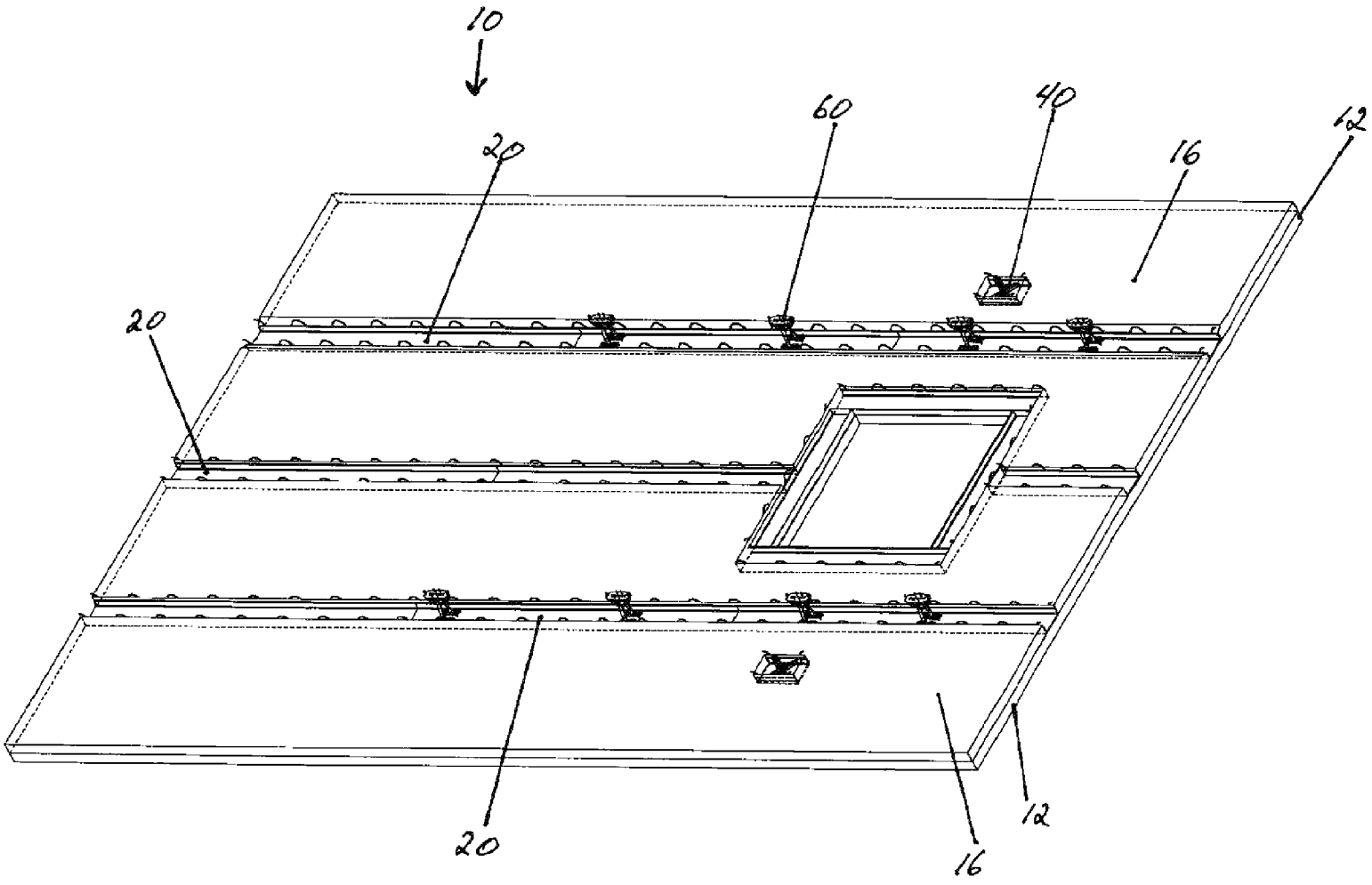
FIG. 6 is a top view during a second phase of construction with insulation layer in place.
Figure 7:
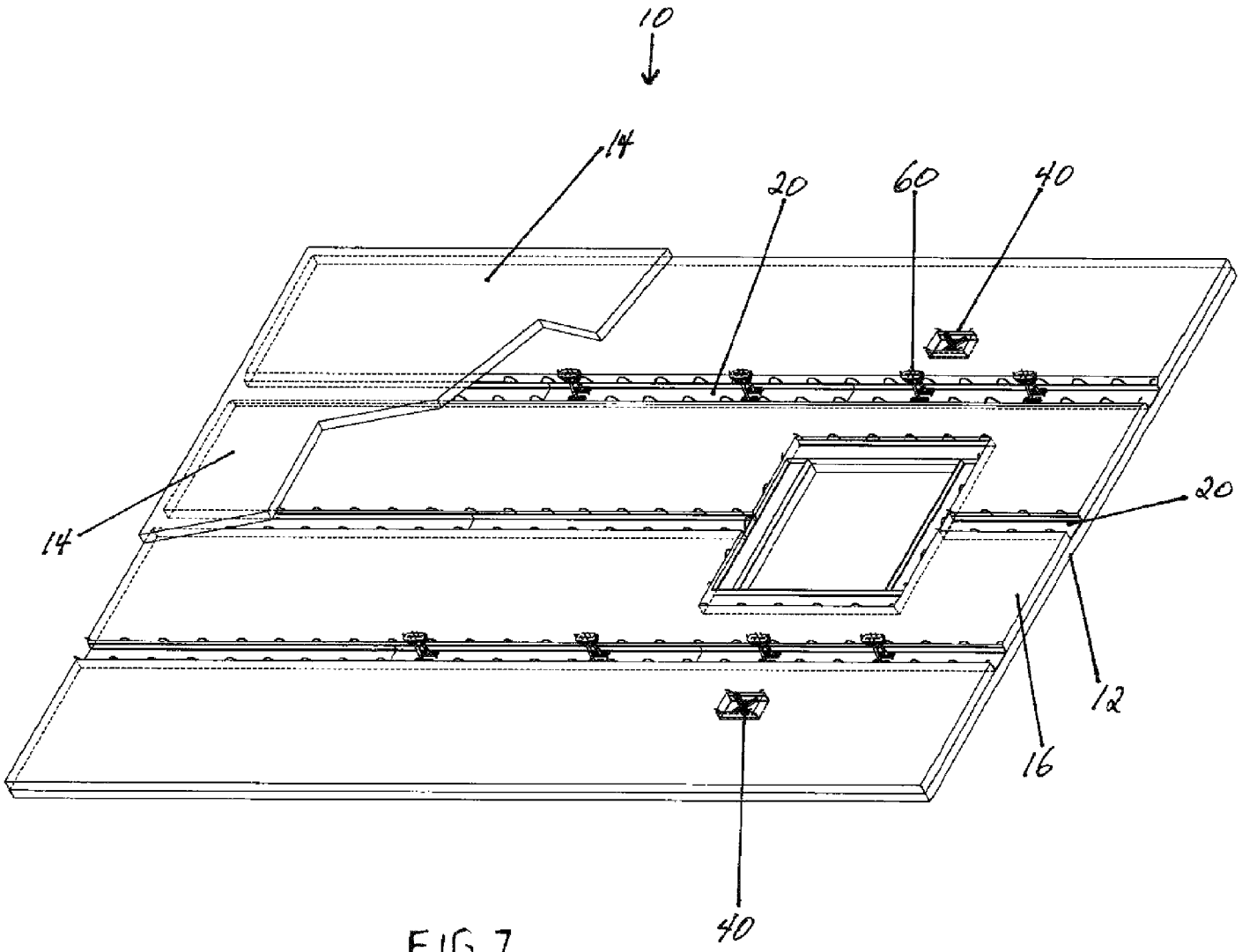
FIG. 7 is a top view during a final phase of construction with upper wythe being laid.
Figure 8:
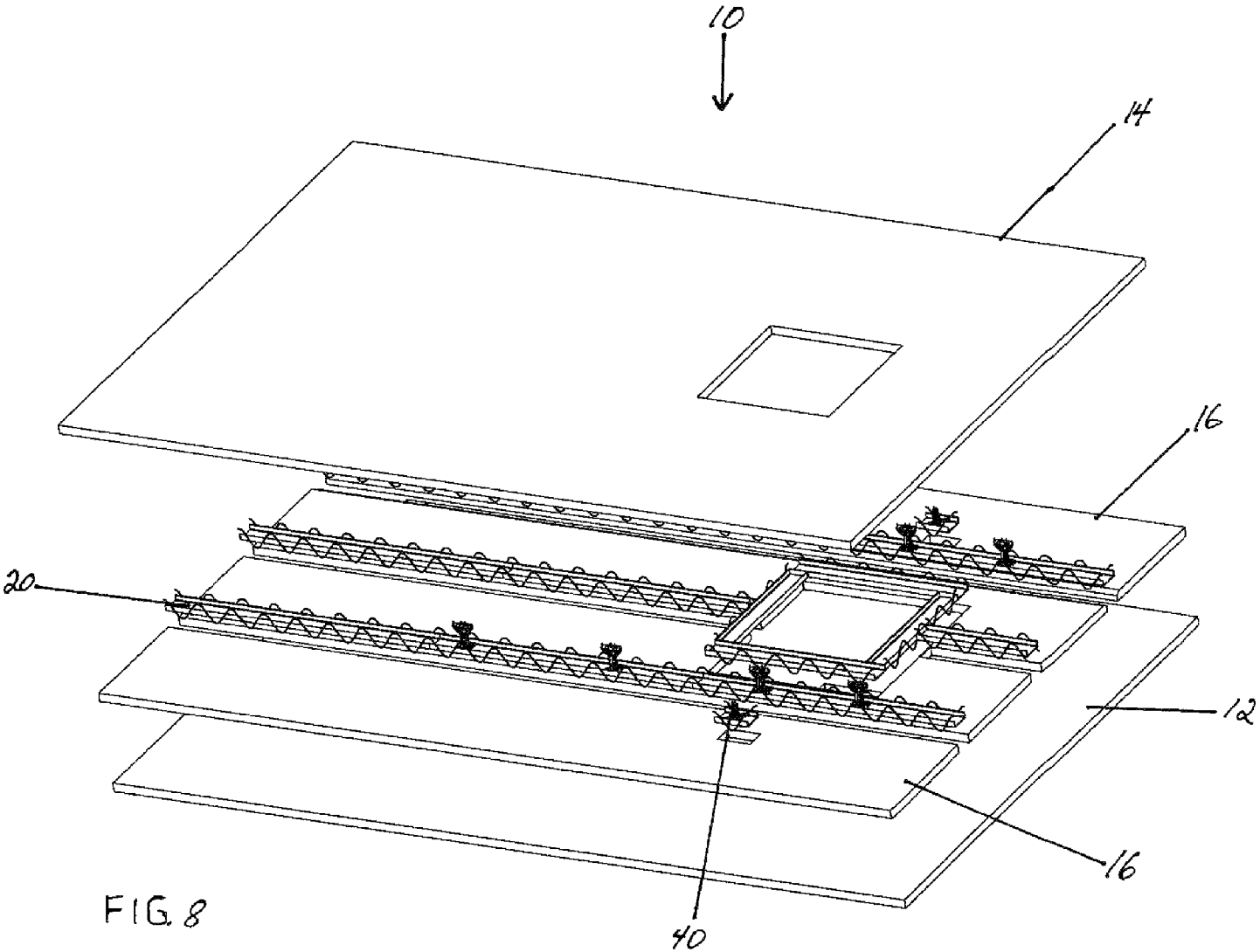
FIG. 8 is an exploded view of the present invention.

An alternative embodiment of the channel 30 and rods 36 is illustrated in FIG. 3. The channel 30 has a base wall 32 and a pair of opposed side walls 34. The rods 36 are in a square shaped pattern, and have peaks at regular intervals engaging with the wythes 12, 14. The square pattern is possible without affecting the integrity of the channel 20.

The channel 20 aligns and orients the rods 26 to provide shear force resistance for the sandwich panel. As illustrated in FIG. 1, the rounded corners of the sine wave pattern assist in distributing connection forces.

The system of construction of the panel 10 is illustrated in FIGS. 4-8. On a suitable flat surface mold which defines the geometric shape and perimeter of a constructed panel is laid out, and the casting surface prepared. Reinforcement material is mounted for the lower wythe of the mold.

Concrete is deposited in the mold to a thickness of the lower wythe 12. The consistency of the concrete performs optimally with a higher slump from self-consolidating to 6" (low viscosity). While the concrete is still plastic, connective means to secure the lower and upper concrete wythes are employed. The channel 20 is positioned and mounted for appropriate alignment. The channel 20 properly orients the rods and is of sufficient weight to sink the rods into the lower wythe 12, yet light enough and of sufficient width to float on the concrete. The use of two opposed rods 26 helps lower the point loads of the connection between the upper and lower wythes.

The insulating layer 16 is then applied. As noted above, the standard insulating panel is normally composed of solid materials, such as polystyrene and the like. The present invention provides an expanding polyurethane foam as the insulating layer and is applied as a liquid on the surface of the lower wythe 12. The upper portions of the rods 26 are left exposed. The amount of foam insulation is determined by the insulation requirements based upon the required R value and the total structural thickness of a completed panel. The lower wythe 12 can be cured or uncured. If uncured, then an additional thin sacrificial layer of foam is applied prior to the application of the polyurethane foam. The foam provides a vapor barrier without joints. Board foam is has joints.

Brace inserts 40 and lift inserts 60 are mounted on the base walls 22, 32 of the channels 20, 30. While the concrete is still plastic, additional connective means to secure the lower wythe 12 and upper concrete wythe 14 are employed.

Figure 9:
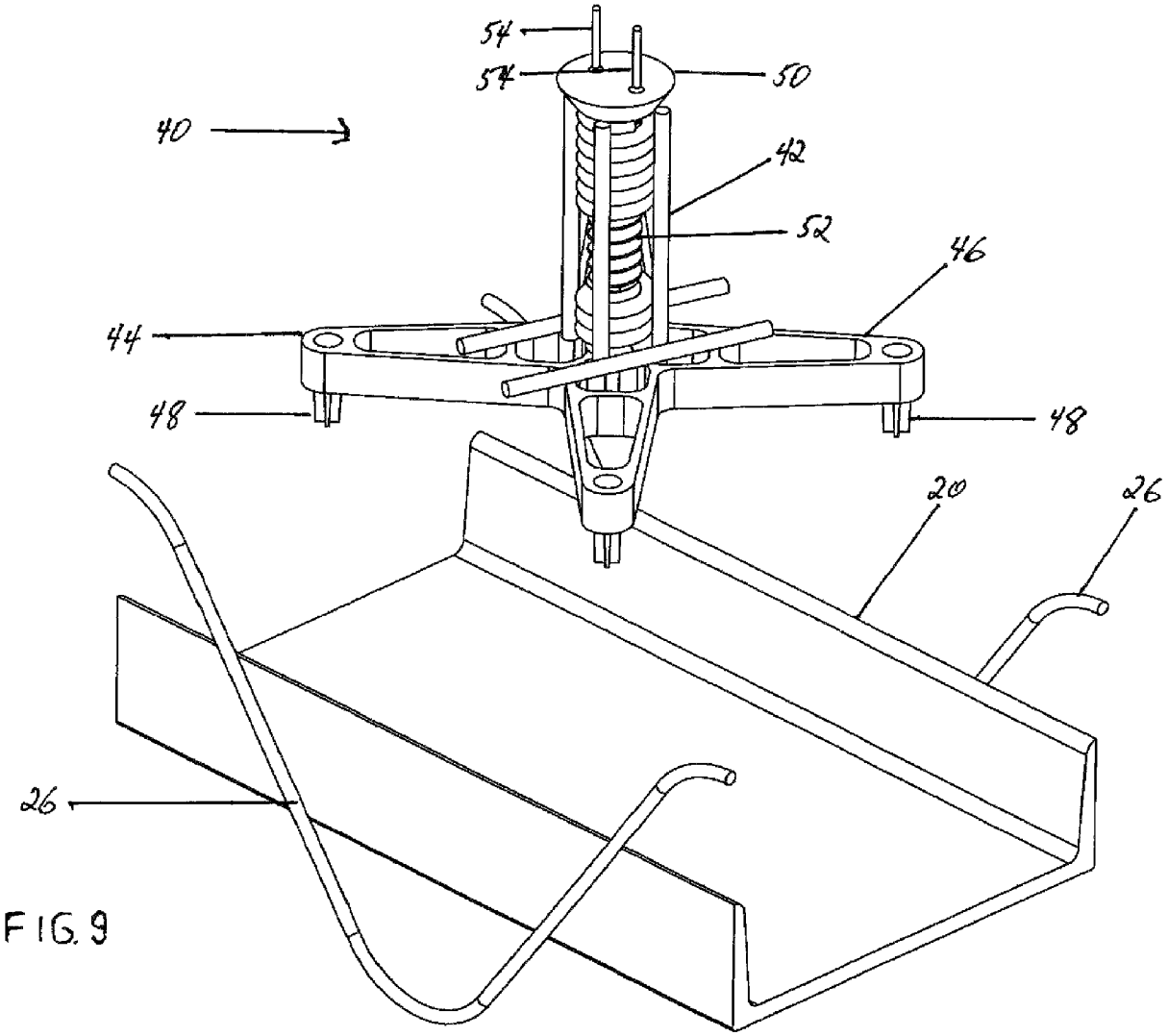
FIG. 9 is a perspective view of a brace insert above a channel.
Figure 10:
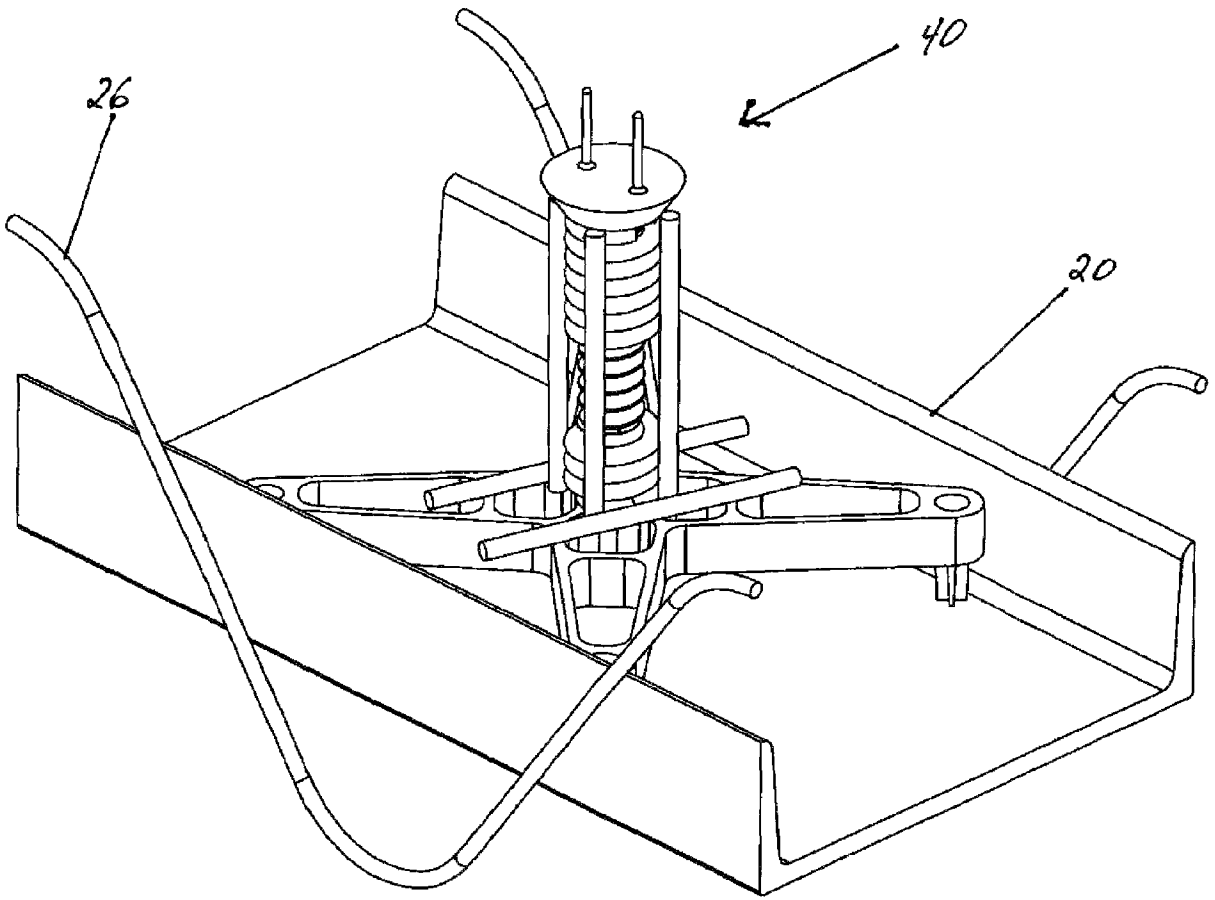
FIG. 10 is a view of the brace insert mounted in a channel.

As illustrated in FIGS. 9 and 10, the brace insert 40 comprises a frame 42 having a pedestal 44 with arms 46 oriented perpendicular to each other. Appendages 48 depend downwardly from a lower surface of the antis 46. A plastic bolt 52 is positioned medially on the pedestal 44. A plastic cap 50 with extensions 54 is placed on the bolt 52. The extensions 54 make the location, of the insert 40 easier to find when it is cast in concrete. The pedestal 44 of the brace insert 40 is of pre-determined size to allow the insert 40 to be mounted on the channel 20, and allows the insert 40 to remain stable during installation process. The brace insert 40 provides for ease of bolt connection to temporary bracing during construction.

Figure 11:
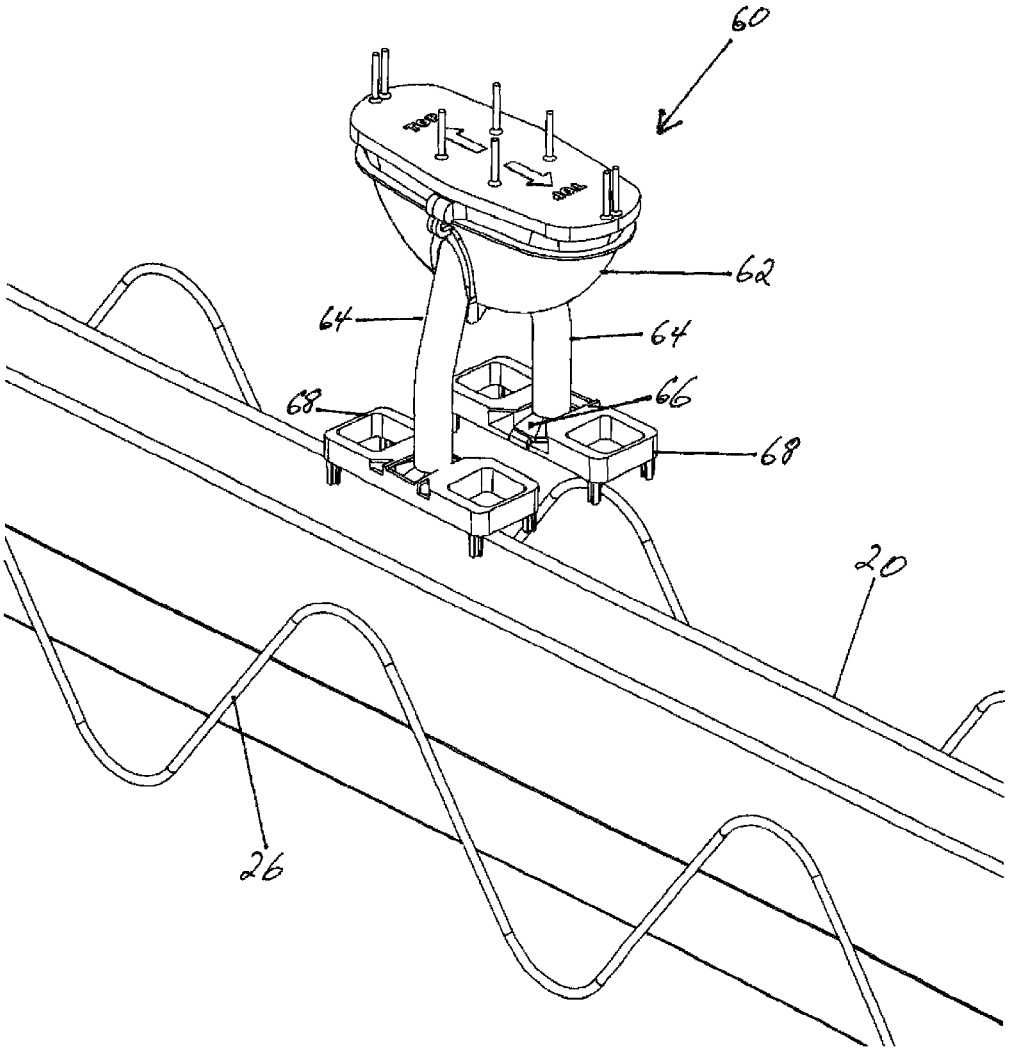
FIG. 11 is a perspective view of a lift insert above a channel.
Figure 12:
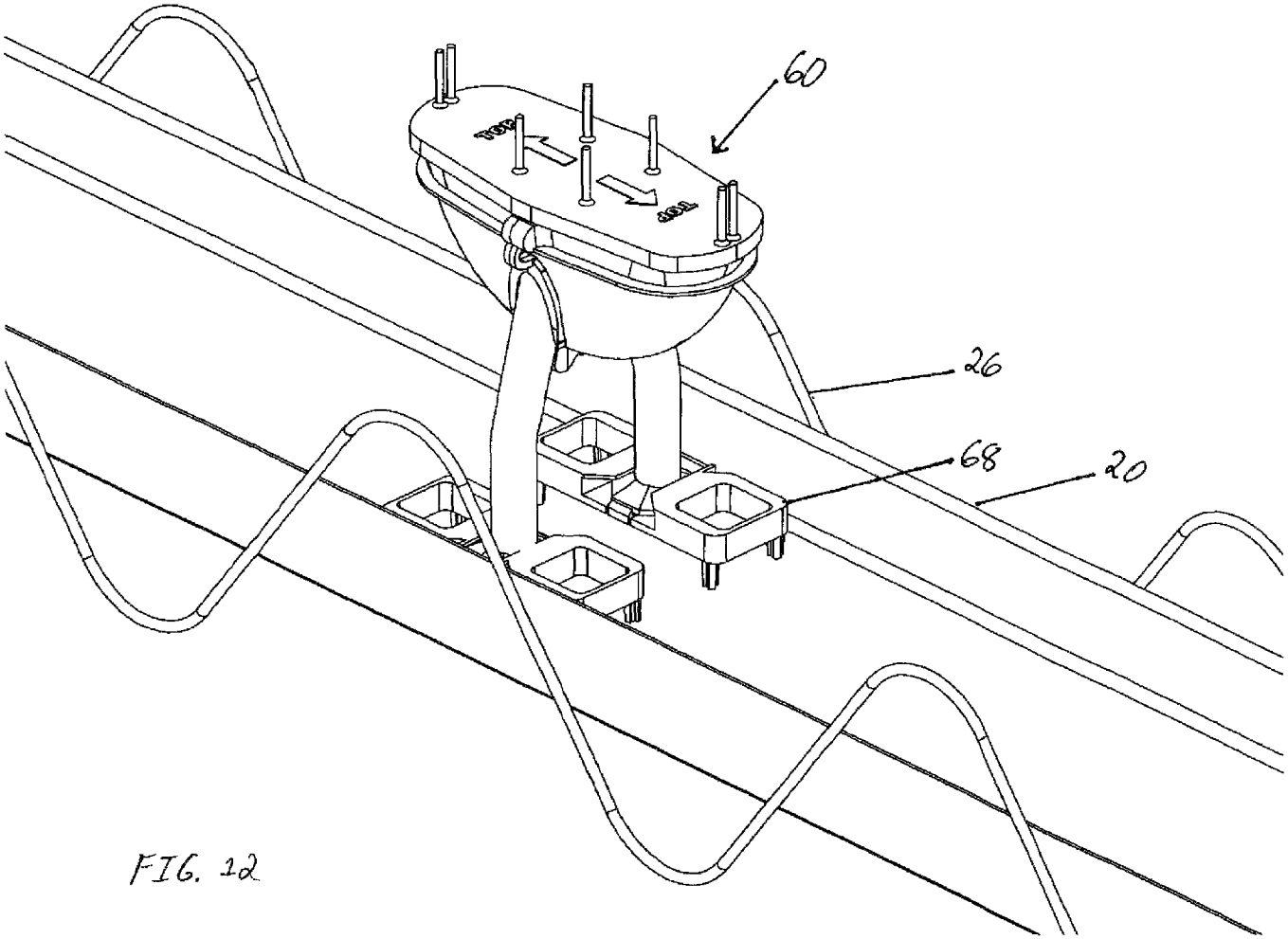
FIG. 12 is a view of the lift insert mounted in a channel.
Figure 13:
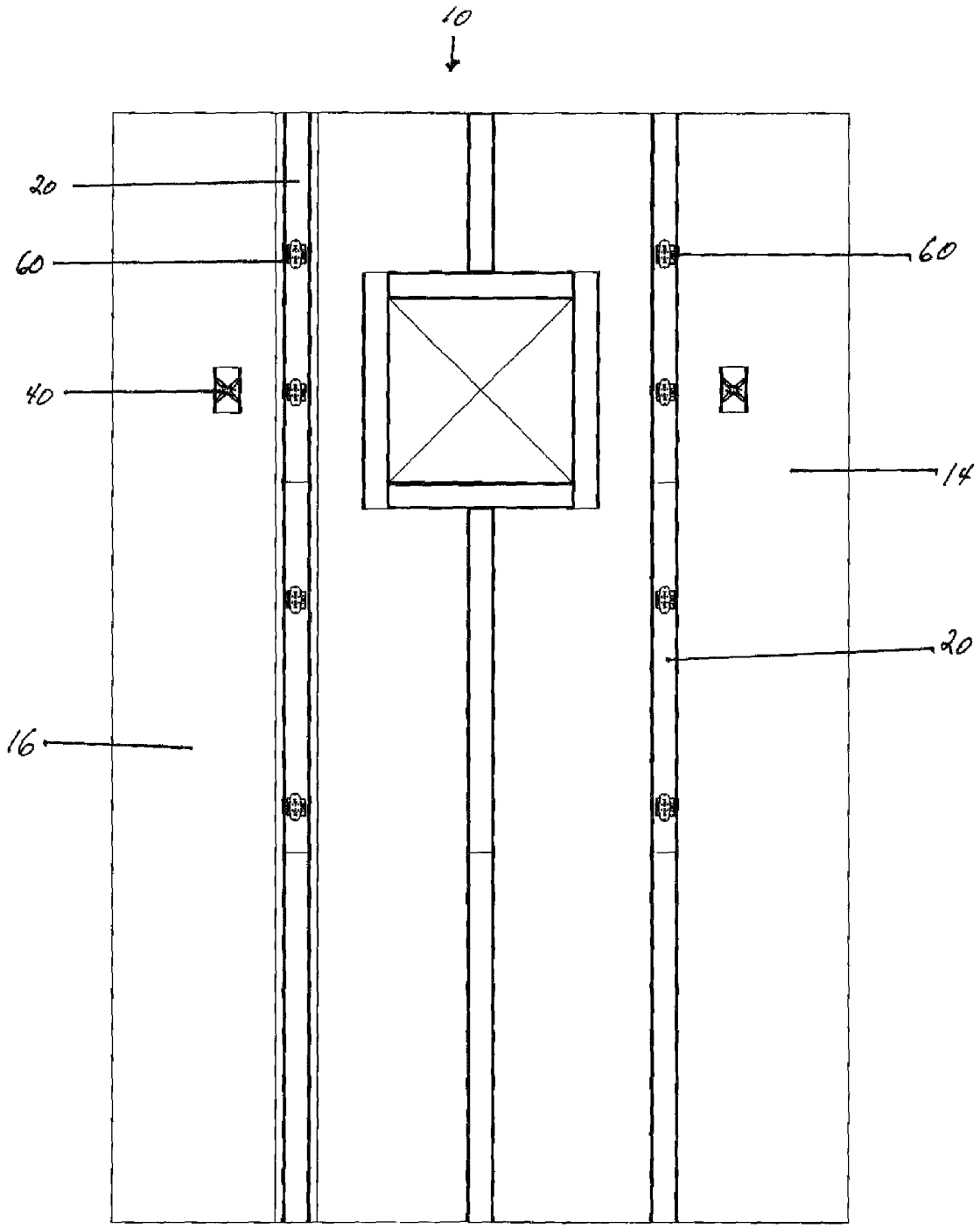
FIG. 13 is a top plan view with the upper wythe layer removed illustrating positioning of lift inserts and brace inserts.

As illustrated in FIGS. 11 and 12, the lift insert 60 comprises an upper section 62 and a pair of columns 64 with base feet 66. The insert 60 mounts snugly into platforms 68. As shown, the insert 60 and platforms 68 are mountable on the channel 20, and allow for an attachment for moving and handling of the panel 10.

Construction continues with reinforcement material is mounted for the upper wythe 14 of concrete. Concrete is deposited in the upper wythe 14. Once the concrete is set the completed panel is disengaged from the mold and transported to its final vertical position in the structure.

It should be noted that there are no limitations on the composition of the channel and the rods because of the number of variables involved. It should be noted that the dimensions of the channels may change as needed in the industry. As can be readily seen, the channel with affixed rods provides improved connection means between the upper and lower wythes.

Multiple channels 20, 30 are available for on-site construction and stacking feature of the channels 20, 30 provides for proficient shipping and increased installation rate.

The channel 20, 30 can also operate as a caddy to place lifting devices and other connection hardware. At times it may be necessary it is necessary to obtain increased depth of the top layer of concrete without applying foam to increase the capacity of the inserted lifter or connection. The base wall of the channels provide a thermal break and minimal insulation, while forming a pocket in the foam achieving minimal thermal resistance.

Additionally, the channels 20, 30 provide a visual cue to ascertain the amount of foam being applied during installation. There is no limitation on the type of foam as the insulating layer used in the precast concrete sandwich panels as there may be changes as needed in the industry.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. A precast concrete sandwich panel, comprising in combination:

a lower wythe with reinforcement material embedded therein;

an upper wythe with reinforcement material embedded therein;

an insulating layer formed between the lower wythe and the upper wythe;

at least one channel having a base wall, a pair of opposed side walls and a pair of rods permanently affixed to an outer surface of the opposed side walls of the channel, and being oriented during construction of the panel, and whereby the rods being of a sine-wave shaped pattern defined by peaks spaced at a regular interval and with peak-to-peak amplitude greater than the insulating layer and mechanically joined with the lower wythe and the upper wythe; and at least one the lift insert mountable in the at least one channels comprising a pair of columns having base feet integrally formed on the end of each column, and whereby the base feet mount on a pair of platforms.

2. The panel as set forth in claim 1, further comprising at least one brace insert mountable in the at least one channel, and whereby the brace insert comprises a frame having a pedestal with arms oriented perpendicular to each other, a bolt positioned medially on the pedestal and appendages depending downwardly from a lower surface of the arms.

* * * * *